US005588192A

United States Patent [19]

Bertoldo et al.

[11] Patent Number: 5,588,192

[45] Date of Patent: Dec. 31, 1996

[54] PROFILED CYLINDER FOR TEASELING AND/OR FLUFFING MACHINES

[75] Inventors: Franco Bertoldo, Brogliano; Gino Dalla Vecchia, Santorso, both of Italy

[73] Assignee: Sperotto Rimar S.p.A., Milan, Italy

[21] Appl. No.: 379,154

[22] Filed: Jan. 27, 1995

[30] Foreign Application Priority Data

Jan. 27, 1994 [IT] Italy ..... MI94A0130

[51] Int. Cl.[6] ..... D06C 11/00

[52] U.S. Cl. ..... 26/37; 26/28; 26/31

[58] Field of Search ..... 26/27, 99, 28, 26/29 R, 31, 37, 25, 30, 32; 492/30, 31, 35, 43, 44

[56] References Cited

U.S. PATENT DOCUMENTS

| | | | |
|---|---|---|---|
| 957 | 10/1838 | Pratt | 26/31 |
| 36,550 | 9/1862 | Millar | 26/29 R |
| 177,662 | 5/1876 | Richardson | 26/28 |
| 455,729 | 7/1891 | Schofield | 26/31 |
| 522,728 | 7/1894 | Clarenbach, Jr. | 26/31 |
| 634,307 | 10/1899 | Neidhardt | 26/99 |
| 679,425 | 7/1901 | Kertesz | 26/99 |
| 1,009,432 | 11/1911 | McClain | 26/2 R |
| 1,411,071 | 3/1922 | Tomlinson | 26/28 |
| 2,035,640 | 3/1936 | Dickie et al. | 26/27 |
| 2,338,828 | 1/1944 | Weiner | 26/37 |
| 3,408,709 | 11/1968 | Reitz | 26/27 |

FOREIGN PATENT DOCUMENTS

| | | | |
|---|---|---|---|
| 381864 | 8/1990 | European Pat. Off. | 26/31 |
| 216448 | 8/1908 | Germany | 26/31 |
| 226316 | 8/1985 | Germany | 26/31 |

*Primary Examiner*—Amy B. Vanatta
*Attorney, Agent, or Firm*—Cushman Darby & Cushman IP Group of Pillsbury Madison & Sutro LLP

[57] ABSTRACT

A profiled cylinder for teaseling and/or fluffing machines of the type having a generally cylindrical outer peripheral surface and provided at its ends with support hubs for its rotation, in which the radially outer peripheral surface has a particular profile caused by a plurality of variously arranged geometrical forms or surface portions disposed for abraiding contact with a fabric which is to be treated by passage through the machine.

1 Claim, 2 Drawing Sheets

PROFILED CYLINDER FOR TEASELING AND/OR FLUFFING MACHINES

BACKGROUND OF THE INVENTION

This invention relates to a profiled cylinder for teaseling and/or fluffing machines.

In machines for treating fabrics by fluffing or teaseling, cylinders are used carrying on their radially outer peripheral surface suitable coverings of specific material, for example abrasive material, to determine the final condition of the fabric.

The material present on the outer surface determines the particular mechanical action on the fabric and hence enables its condition to be changed on the basis of the required form.

SUMMARY OF THE INVENTION

The object of the present invention is to provide an element positionable in a teaseling and/or fluffing machine as an addition to those auxiliary elements which favor improved finishing and which optimize the appearance of the treated fabric.

This object is attained according to the present invention by a profiled cylinder for teaseling and/or fluffing machines of the type having generally a cylindrical radially outer peripheral surface and provided at its axially opposite ends with support hubs for its rotation, characterized in that radially outer peripheral surface has a particular profile made of a plurality of variously arranged geometrical forms or surface portions of any desired kind.

BRIEF DESCRIPTION OF THE DRAWINGS

The characteristics and advantages of a cylinder formed in accordance with the present invention will be more apparent from the description given hereinafter by way of non-limiting example, with reference to the accompanying schematic drawings, in which.

DETAILED DESCRIPTION

The figures show a profiled cylinder for teaseling and/or fluffing machines formed in accordance with the present invention and indicated overall by the numeral 10.

The cylinder 10 is generally of cylindrical shape with support hubs 11 extending from its ends for its rotation.

According to the present invention, the radially outer peripheral surface of the cylinder 10 has a particular profile which can be indicated as consisting of a plurality of geometrical forms of any desired kind.

Figure 1:
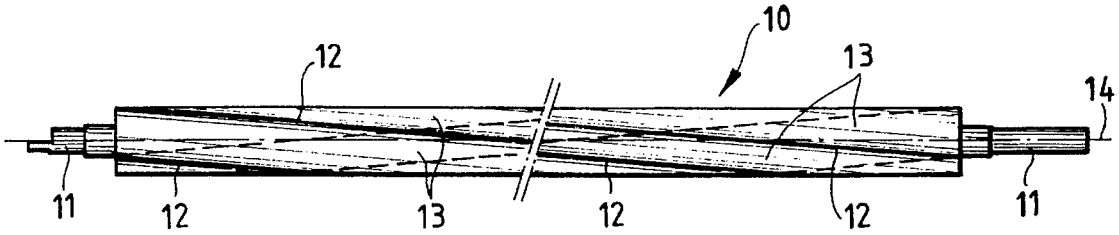
FIG. 1 is a side elevational view of a profiled cylinder for teaseling and/or fluffing machines according to the present invention.
Figure 2:
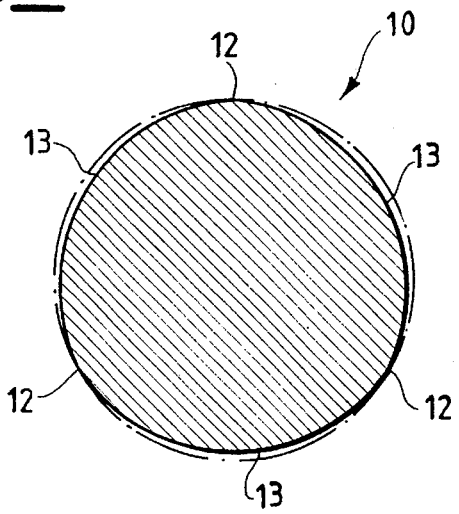
FIG. 2 is a transverse cross-sectional view through the cylinder of FIG. 1.

These geometrical forms are defined on the lateral surface of a first embodiment of the cylinder 10 shown in FIGS. 1 and 2 by a series of crests 12 which wind in accordance with any and variable winding angles and are generally different from the cylinder generatrices.

Between two successive crests 12, there is defined a surface portion 13, identifiable as one of the geometrical forms, which is generally lower than the crests and has a smaller radius of curvature than the crests 12.

In the embodiment shown in FIGS. 1 and 2, the surface portions 13 can be identified as polygonal portions each essentially in the form of a parallelogram, the polygonal portions being twisted about the axis 14 of the cylinder 10. Instead of extending along the entire radially outer peripheral surface, the surface portions 43 bounded by the respective crests 12 can be provided only on discrete portions of the surface of the cylinder 10. They can also alternate with classical cylindrical parts.

Alternatively and advantageously, in a cylinder according to the invention comprising several portions of variable profile, the various portions can be of mutually different extension, hence subjecting the fabric to different types of treatment in its various lateral, selvedge, central and other parts.

Figure 3:
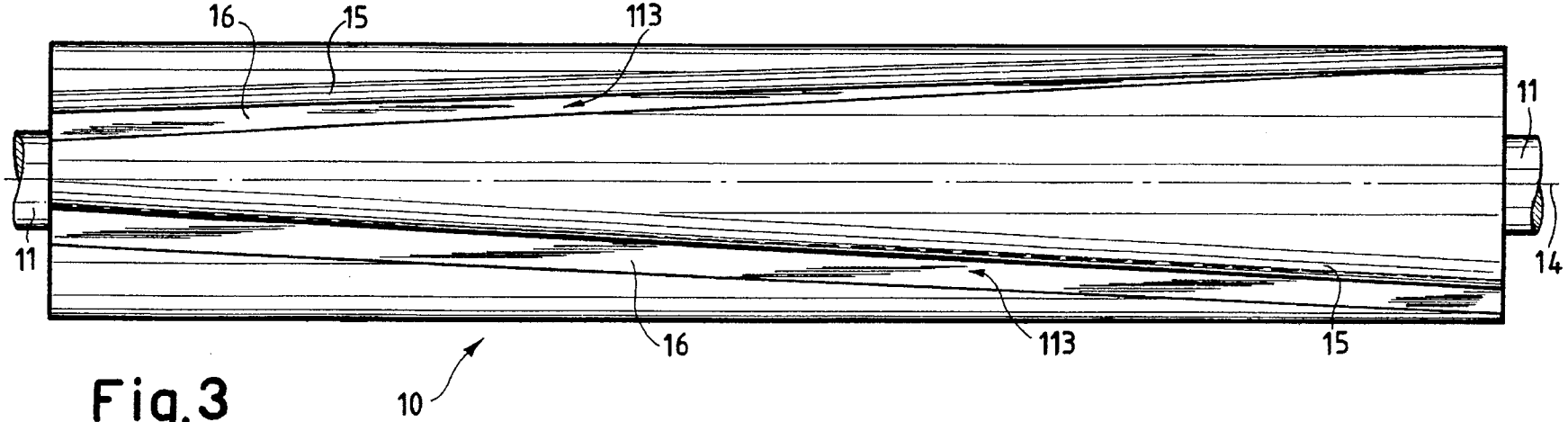
FIG. 3 is a side elevational of a second embodiment of a profiled cylinder for teaseling and/or fluffing machines according to the present invention, taken in the direction of the arrow F of FIG. 4.
Figure 4:
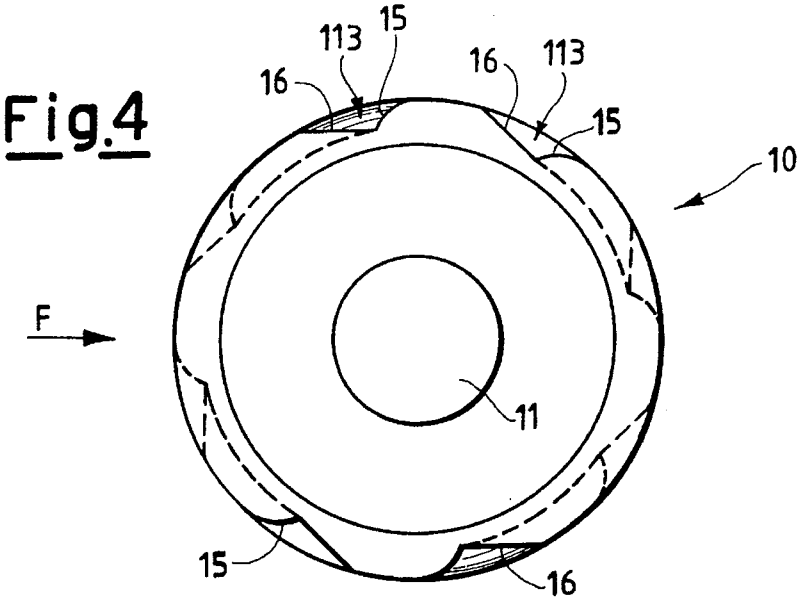
FIG. 4 is an end elevational view of the cylinder of FIG. 3.

FIGS. 3 and 4, show a second embodiment of a cylinder according to the invention, in which the geometrical forms are defined by milling the lateral surface of the cylinder 10.

This milling forms recesses, indicated overall by; 113, which are each shaped as a trapeziod with a first flank/straight and a second flank 15 rounded.

Specifically, FIGS. 3 and 4 show that the radially out peripheral surface of the cylinder according to the invention comprises four recesses 113. Any two successive recesses wind in mutually reverse directions, so as to exert in succession on the fabric an essentially transverse widening action firstly in one direction and then in the other direction.

Advantageously, a teaseling and/or fluffing machine can comprise several cylinders formed in accordance with the first embodiment of the invention with crests winding in opposite directions, so-called right handed and left handed cylinders, so as to subject the fabric to alternating treatment. Alternatively, one cylinder constructed as shown in the second embodiment is sufficient to provide such treatment.

In this respect, twisted portions winding in one direction and twisted portions winding in the opposite direction or differently winding recessed portions can be provided in the surface of one and the same cylinder, or in part of the surface of a cylinder according to the invention.

As stated, such an arrangement comprising one or more cylinders not only exerts the action deriving from the cylinders themselves but also provides a fabric widening action by virtue of the cylinders according to the invention.

It should further be noted that the presence of surface crests or crest portions 12 or of recesses 113 results in a true mechanical action on the fabric. This action can be identified as actual beating of the fabric.

Summarizing, the provision of cylinders according to the invention in a teaseling and/or fluffing machine optimizes its operation.

We claim:

1. A profiled cylinder for a teaseling and/or fluffing machine, comprising:

a cylinder having a generally cylindrical outer peripheral surface, two axially opposite ends, and, projecting axially outwards at said ends, two respective support hubs, for rotation of the cylinder about a longitudinal axis thereof;

each said outer peripheral surface having a circumferentially extending series of alternating crests and recesses, each extending from end to end of said surface;

each crest being defined between two angularly opposite flanks, both of which are oblique to said longitudinal axis, so as to twist about said axis;

said surface being arranged for abraiding engagement with a fabric by turning of the cylinder about said axis while maintaining the fabric in engagement with said surface;

each said crest and each recess being generally arched in transverse cross-sectional shape, each recess having a smaller radius of curvature in transverse cross-sectional shape than each crest;

both said flanks of each crest twisting about said axis in two opposite angular senses, so that each crest is trapezoid-shaped in front elevational profile; and on each crest, a respective one of said flanks being generally flat in transverse cross-sectional profile and the other being generally convex in transverse cross-sectional profile.

* * * * *